United States Patent [19]

Bohannon, Jr.

[11] 4,308,662

[45] Jan. 5, 1982

[54] METHODS OF AND APPARATUS FOR FORMING A METALLIC TAPE INTO A TUBE HAVING AN OVERLAPPED SEAM

[75] Inventor: William D. Bohannon, Jr., Lawrenceville, Ga.

[73] Assignee: Western Electric Company, Inc., New York, N.Y.

[21] Appl. No.: 52,165

[22] Filed: Jun. 26, 1979

[51] Int. Cl.[3] ..... H01B 13/26; B21D 39/02

[52] U.S. Cl. ..... 29/828; 72/51; 72/52; 156/54

[58] Field of Search ..... 174/109, 105 R, 107; 29/728, 828; 228/129, 148, 130; 156/54, 203; 428/129; 264/171, 172, 174, 271.1, 272.11, 272.12

[56] References Cited

U.S. PATENT DOCUMENTS

| | | | |
|---|---|---|---|
| 2,285,263 | 6/1974 | Fitch | 93/82 |
| 3,087,007 | 4/1963 | Jachimowicz | 228/129 |
| 3,816,643 | 6/1974 | Pechhold | 156/54 |
| 3,826,862 | 7/1974 | Ichiba et al. | 174/107 |
| 3,843,568 | 10/1974 | Woodland et al. | 174/107 |
| 4,025,375 | 5/1977 | Leasure | 156/203 |
| 4,035,211 | 7/1977 | Bill et al. | 156/54 |
| 4,049,904 | 9/1977 | Hori et al. | 174/7 |
| 4,100,003 | 7/1978 | Trusch | 156/54 |
| 4,151,365 | 4/1979 | Hacker | 156/54 |

FOREIGN PATENT DOCUMENTS

| | | | |
|---|---|---|---|
| 137026 | 6/1902 | Fed. Rep. of Germany | 228/148 |

*Primary Examiner*—Stanley S. Silverman
*Attorney, Agent, or Firm*—E. W. Somers

[57] ABSTRACT

The invention relates to the formation of a substantially circular metallic shield (37) about a cable core (32) by wrapping a metallic tape (64) longitudinally about the core with longitudinal edge portions of the tape being overlapped by a forming key (100) to provide a closed seam (38). As the seam is formed, an underlying longitudinal edge portion (48) of the shield is supported while an overlying longitudinal edge portion (45) at the overlap is directed inwardly toward the cable core to preclude its protrusion into a jacket (39) which is subsequently extruded over the shielded cable core. A relatively thin strip (145) of metal attached to an inner surface of the forming key assures formation of the seam before juxtaposing the longitudinal edge portions and the core, and avoids penetration of a priorly formed inner shield by the longitudinal edge of the outer shield to prevent rotation of the inner shield and undesirable alignment of the shield seams. The formation of cable shields in accordance with this invention and the subsequent extrusion of a plastic jacket thereover results in a cable having a substantially monolithic sheath which minimizes slippage of elements of the sheath relative to one another during field cable pulling operations.

5 Claims, 25 Drawing Figures

Fig. 6
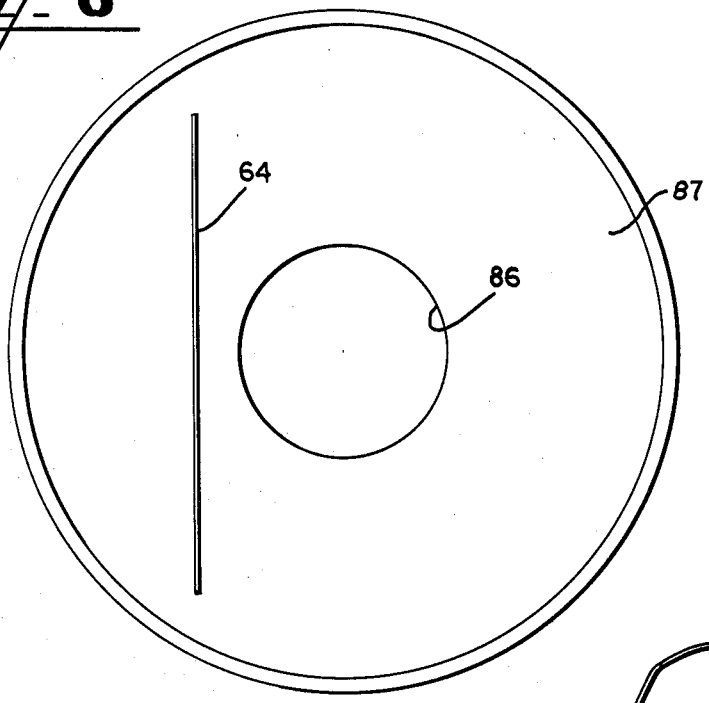
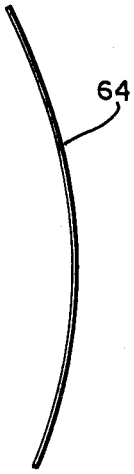
Fig. 7
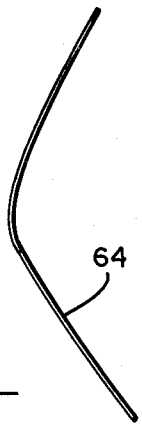
Fig. 8
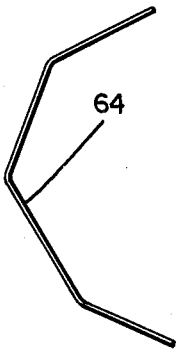
Fig. 9
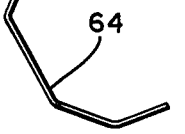
Fig. 10
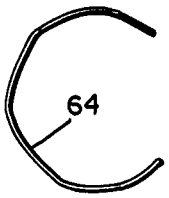
Fig. 11

METHODS OF AND APPARATUS FOR FORMING A METALLIC TAPE INTO A TUBE HAVING AN OVERLAPPED SEAM

TECHNICAL FIELD

This invention relates to methods of and apparatus for forming a metallic tape into a tube having an overlapped seam, and, more particularly, to methods of and apparatus for forming a corrugated metallic tape into a substantially circular shield about an advancing cable core with an overlapped seam having edge portions that neither penetrate a subsequently extruded jacket nor the enclosed core.

BACKGROUND OF THE INVENTION

In the manufacture of a commonly used communications cable, a core comprising a plurality of electrical insulated conductors is enclosed with an aluminum shield or with aluminum and steel shields. The aluminum shield is designed to protect the cable core from lightning damage and from electrical disturbances when installed in the field, while the steel shield provides mechaical and rodent protection for the cable core. When two shields are used, the steel shield typically is the outer of the two. The shields are formed from continuous tapes which are often corrugated and which are wrapped longitudinally about the cable core with corrugations of the longitudinal edge portions of the shield intermeshed to form an overlapped seam.

Early on, it was common practice to join the overlapping edge portions of the seam by soldering, or by an adhesive to form a hermetic seal to prevent moisture penetration of the cable core. With the advent of a waterproofing system for communications cable, of the type shown, for example, in U.S. Pat. No. 3,607,487, issued to M. C. Biskeborn et al on Sept. 21, 1971, it was no longer necessary for the shield seam to be joined to form the hermetic seal as long as longitudinal edge portions of the metallic shield were overlapped and a closed seam produced by suitable forming or working of the metal tape.

In manufacturing such a cable with an unjoined seam, it was found that an outer overlapping edge portion of the metallic shield tended to rebound subsequent to forming and to project outwardly, rather than to have its corrugations in a nested mating relation with the corrugations of the adjacent inner edge portion. The shield and the core tended to form a partially completed cable with a distorted non-circular periphery in which the outer edge of the shield possibly protruded into or through an outer plastic jacket that was extruded around the shield. These deficiencies manifest themselves in ruptured cable most frequently during the reeling or pay-off of the cable upon or from a reel, particularly if done in a relatively cold environment.

Another problem evolves because in order to conserve plastic materials and to provide a more uniform jacket, the shielded cable core is desirably pressure extruded, rather than tubed, which requires that the shielded cable core have a substantially circular configuration. A shield which presents a substantially circular configuration would also be beneficial in that it together with the jacket would result in a monolithic sheath that prevents separation of the component elements of the sheath by relative slippage therebetween during installation in the field.

As for the prior art, W. E. Petersen in U.S. Pat. No. 3,785,048, which issued on Jan. 15, 1974, overforms the outer longitudinal edge portion of a metallic tape, after which it is reverse-formed by passage through an overlapping die in which a forming bar causes the edge portion to have a degree of permanent set. In K. P. Trusch U.S. Pat. No. 4,100,003 issued July 11, 1978, an outer longitudinal edge portion of a metallic tape along an overlapped seam is directed toward an inner edge portion a distance sufficient to preclude the outer edge portion from protruding into a subsequently extruded jacket. However, the inner longitudinal edge portion at the seam is unsupported during the seam forming and tends to be pushed in toward the core as the outer edge portion is directed inwardly.

SUMMARY OF THE INVENTION

The foregoing problems of the prior art which deals with the forming of metallic tubes are overcome by the methods and apparatus of this invention in which a tape is formed into a substantially circular tube having a substantially closed overlapped seam comprising preformed longitudinal edge portions. This invention may be used to form a tube having an overlapped longitudinal seam by moving successive increments of the tape through a converging opening to cuase successive increments to have a generally circular configuration with longitudinal edge portions of the successive increments being adjacent each other. Then the partially formed tube is passed through an overlap and forming die section wherein longitudinal edge portions of the tape are guided into juxtaposition with each other and an overlying longitudinal edge portion is directed inwardly into substantialy continuous engagement with an underlying edge portion while the underlying edge portion is supported to prevent its deflection inwardly toward a longitudinal axis of the tube as the overlying longitudinal edge portion is engaged therewith.

A system for forming a corrugated tape into a cable shield having an overlapped seam which comprises overlying and underlying longitudinal edge portions includes means for advancing a tape along a path of travel through an opening which converges in the direction of advance of the tape. A tube extends through the converging opening with its axis coincident with the axis of the opening and means are provided for advancing a cable core which is to be enclosed by the shield through the tube. A plurality of annular members are disposed adjacent the converging opening and concentrically about a leading end of the tube and have successively decreasing openings. A die section is positioned adjacent the annular members and includes a key extending along a portion of the length of the die section and attached thereto. The key includes means for receiving and guiding the longitudinal edge portions of the tape to form an overlapped seam while directing the overlying longitudinal edge portion inwardly toward the core and into nesting engagement with the underlying longitudinal edge portion which is supported to prevent its deflection inwardly toward the core. The system is effective to produce a shield having a substantially circular configuration and one in which the longitudinal edges are maintained in substantial engagement with each other to form a substantially closed seam.

BRIEF DESCRIPTION OF THE DRAWINGS

Other features of the present invention will be more readily understood from the following detailed description of specific embodiments thereof when read in conjunction with the accompanying drawings, in which:

FIG. 6 is an end view of an entrance section of the forming system in FIG. 5 and showing an end view of a metal tape being advanced thereinto;

FIGS. 7–11 are a sequence of views of the metal tape in sequential stages of its formation to a configuration just prior to juxtaposing and overlapping of the longitudinal edge portions;

DETAILED DESCRIPTION

Figure 1:
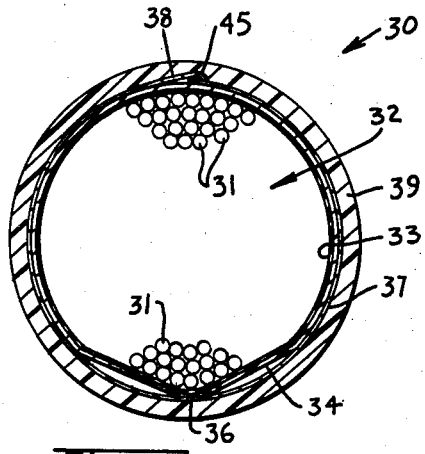
FIG. 1 is a cross-sectional end view of a completed cable having a shield formed in accordance with this invention.

In one commonly manufactured communications cable 30 (see FIG. 1), a plurality of twisted pairs of insulated conductors 31—31 are stranded together to form a unit, one or more of which comprises a cable core designated generally by the numeral 32. The core 32 is enclosed with a plastic tape 33, an aluminum shield 34 having an open bifurcated seam 36 and an outer steel shield 37 having a longitudinal overlapped seam 38. While not shown in the drawing, each of the shields 34 and 37 are corrugated with corrugations of the shields along the seam being intermeshed together. The double shielded core 32 is enclosed with a jacket 39 of plastic such as polyethylene, for example.

Figure 2:
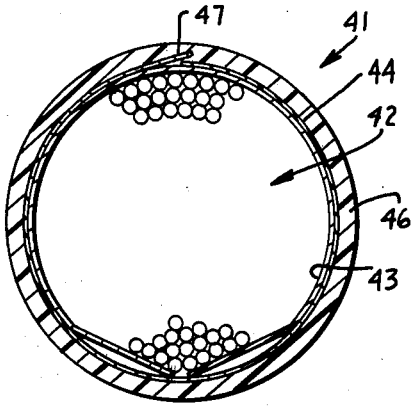
FIG. 2 is a view similar to FIG. 1 but showing a prior art cable with an overlying edge of a metal shield protruding or extending into a subsequently extruded jacket.

If reference is made to FIG. 2, there is illustrated in cross-section a prior art type of cable, designated generally by the numeral 41, in which a core 42 is enclosed with an aluminum inner shield 43. A steel shield 44 is formed over the aluminum shield 43, with an overlapping longitudinal seam which is not joined together such as for example, by soldering, or preforming may result in one of the longitudinal edges 47 protruding into a plastic jacket 46.

Figure 3:
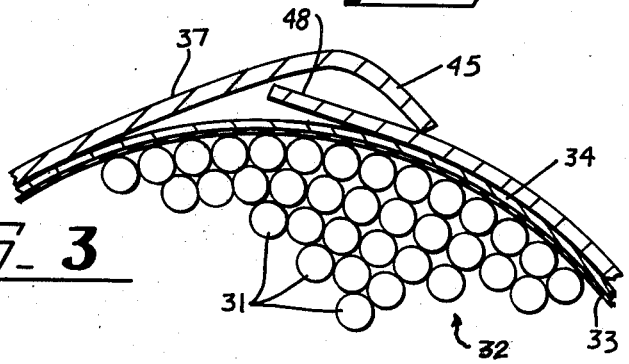
FIG. 3 is an enlarged view showing an overlapped seam of a shield with overlying and underlying longitudinal edge portions of the metal shield formed in accordance with the present invention but exaggerated as to scale for purposes of clarity.

An enlarged view of a portion of a cable made in accordance with this invention is shown in FIG. 3, with the overlapping seam portion 38 exaggerated to show more clearly. It may be seen that one longitudinal edge portion 45 of the outer shield 37 is turned toward the inner shield 34 and the cable core 32 a distance sufficient to prelude the end portion of the shield from protruding into the jacket 39. This, together with a substantially linear underlying longitudinal edge portion 48, results in a structure which forms a substantially closed seam.

Figure 4:
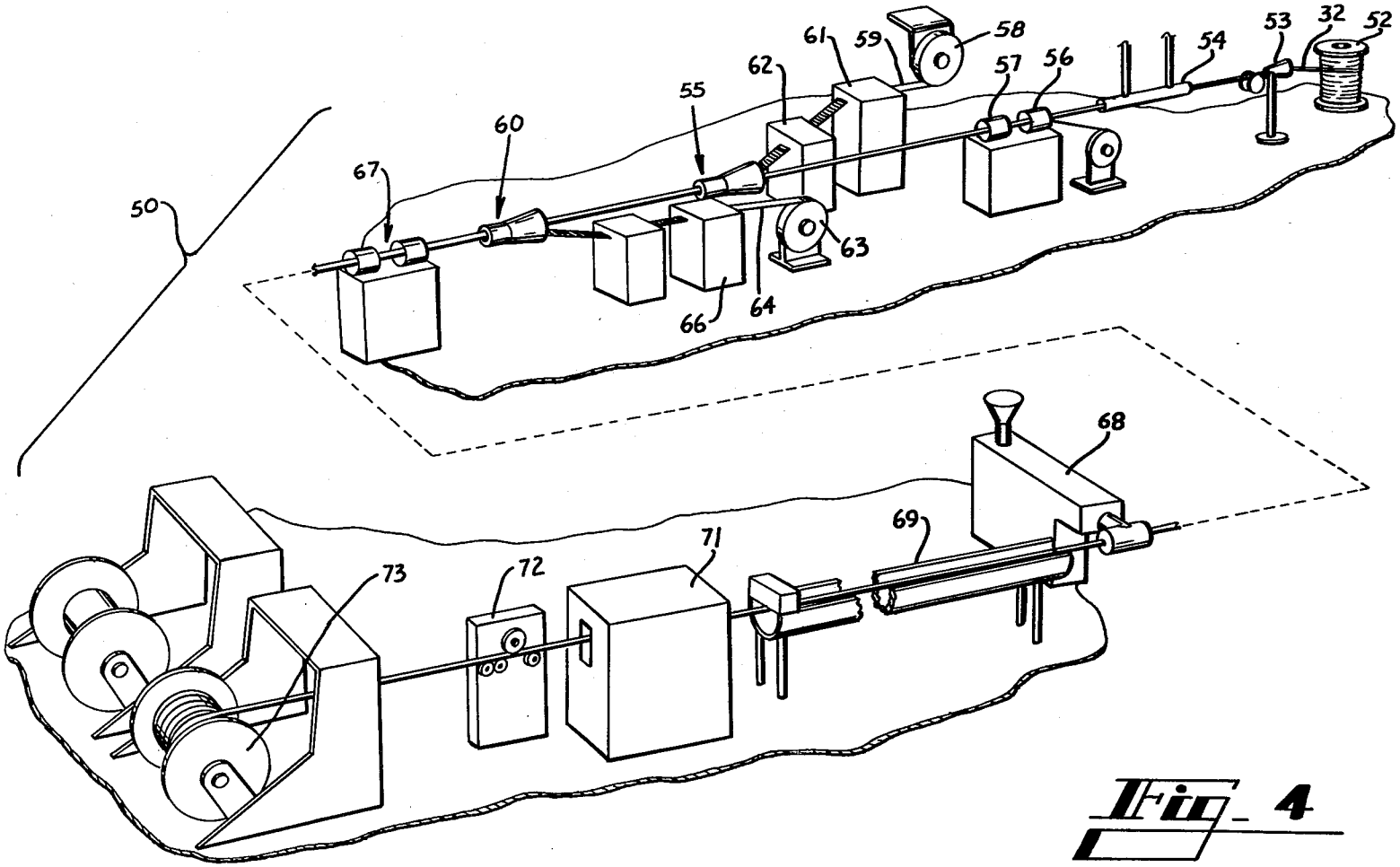
FIG. 4 is a perspective view of a manufacturing line for forming two metal shields and a jacket about a cable core.

In a typical manufacturing line, such as is shown in FIG. 4 and designated generally by the numeral 50, for sheathing a cable core 32, the cable core is payed off from a reel 52 through a cable core guide 53. The core 32 is passed through a filling chamber 54 wherein petrolatum compound is forced into the interstices of the core by apparatus, for example, of the type disclosed in U.S. Pat. No. 3,876,487, issued to C. E. Garrett et al on Apr. 8, 1975. After the core 32 leaves the filling chamber 54, petrolatum compound is delivered to its outer surface to assure an outer covering of the compound about the unit. The core wrap tape 33 is longitudinally formed about the unit and bound by binders from heads 56 and 57.

In order to describe the preferred embodiment of this invention, the manufacture of a double shielded core 32 will be disclosed. From a roll 58, unformed aluminum strip or tape 59 is advanced into a corrugator 61, coated with a waterproofing compound by an applicator 62, then formed about the advancing cable core 32 by a forming system 55 which is known in the art. The aluminum tape 59 is wrapped longitudinally about the core 32 to form an open seam. Similarly, a roll 63 of unformed steel tape 64 is provided, with successive increments thereof being payed off, corrugated and coated with a waterproofing compound preparatory to being wrapped longitudinally about the core 32 and the inner aluminum shield by a second forming system in accordance with the invention and designated generally by the numeral 60. The double shielded core 32 is then passed through a head 67 which binds the shielded core 32 in directions required to maintain the formed seam as the shielded core is advanced into and through the extruder where the plastic jacket 39, such as, for example, polyethylene, is extruded about the shields. The jacket 39 is cooled in a water trough 69 and the cable 30 moved through a tractor capstan 71, through a footage counter and marker 72, and is taken upon on a reel 73.

Turning now to the forming of the shield 37, the core 32 and the tape 59 are moved into the forming system 60 (see FIG. 5), wherein the tape 64 is wrapped longitudinally about the core 32. The system 60 is comprised of a preparation section 81, a transition section 82, and a final die section 83, all supported within a housing 85, and is designed to form the tape 64 from a planar cross sectional configuration into one which is substantially circular and generally encloses the cable core 32 with a substantially closed seam.

Figure 5:
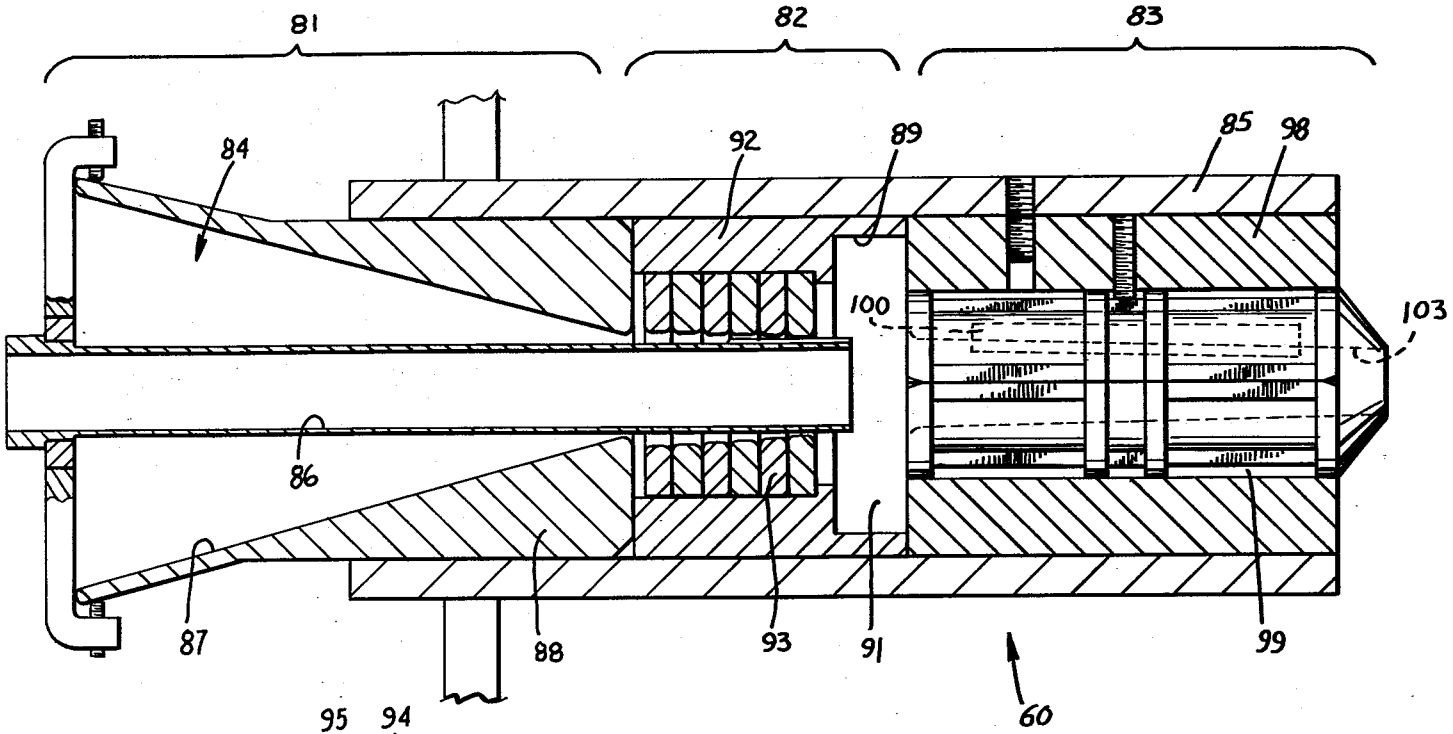
FIG. 5 shows an elevational view partially in section of a forming system.

The preparation section 81 includes a cone former 84 and a centrally disposed tube 85 through which the cable core 32 already enclosed in the aluminum shield 34 is advanced and which has its centerline colinear with that of path of the advancing cable core. Disposed about the tube 86 is a truncated conically shaped surface 87 having a line of generation which makes an angle of about 15° with the axis of the tube 86. As is seen in FIG. 5, the surface 87 provides a converging opening through which the tape 64 is advanced and which converges in the direction of advance of the cable core 32 and the tape. A downstream end of the cone former 84 has a collar 88 attached thereto to mount the cone former to one end of the housing 85.

The exit end of the tube 86 extends beyond the collar 88 into a large diameter portion 89 of a stepped cavity 91 formed through an annular support number 92. A plurality of cone extension rings 93—93 are mounted within the small diameter portion of the member 92 and interposed between the tube 86 and the housing 85. It should also be observed that the thickness of the support member 92 in a radial direction may vary to accommodate different size extension rings 93—93.

In a prior art tool for forming a cable shield, the tape 64 was advanced into a cone former and then its edges were directed into engagement with guideways in a forming tool. The change from the cone former to the tool was abrupt, whereas in the apparatus of this invention, the plurality of rings 93—93 provide a gentle change from the cone former 84 to the final die section 83. The plurality of rings 93—93 have successively decreasing inner diameters with an inner peripheral edge of each being rounded to prevent damage to the tape as it is moved therepast. The tape 64 is formed into a curved configuration between the rings and the outside diameter of the tube 86, with the clearance between the inner one of the rings 39—39 and the tube being about 0.20 cm.

It should also be apparent that as the tape 64 is advanced into the cone former 84 and thence through the transition and die sections 82 and 83, respectively, the only active force applied to the tape is that applied by the capstan 71 in advancing the enclosed core along the manufacturing line.

Figure 12:
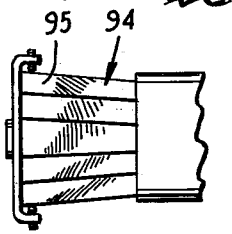
FIG. 12 is a view of an alternate embodiment of the entrance section of the forming system shown in FIG. 5.

Viewing now FIG. 6, there is shown an end view of the cone former 84 as the tape 64 is advanced thereinto. As the tape 64 first engages the curved wal of the cone former, it buckles inwardly and is caused to assume the shape shown in FIG. 7. Then further along into the cone former 84, the center portion of the tape 64 moves outwardly into engagement with the conically shaped surface 87 as shown in FIG. 8. This reversal of curvature of the tape 65 in the entrance portion of the cone former 84 may be avoided by constructing a former 94 (see FIG. 12) having a plurality of flat quadrilateral surfaces 95—95, as opposed to a continuously curved surface, which converge in the direction of advance of the tape 64 and the core 32. The use of the latter disclosed former 94 results in the tape 64 assuming the shape shown in FIG. 8 as it engages the cone.

As the tape 64 continues along through the cone former 84, it assumes successively each of the shapes shown in FIGS. 9–11. Each successive shape includes a increased number of break points and increased number, but shorter, segments. This arrangement is used to minimize the bending at any one time and the friction loading which is imparted to the tape 64 to prevent corrugation pull-out.

After the tape 64 leaves the cone former 84, it enters the transition section 82 where the longitudinal edge portions are further turned inwardly between the rings 93—93 and the tube 86. This further forms the tape 64 toward a circular configuration with the longitudinal edges adjacent each other and adapted to be received by tooling in the die section 83. Successive increments of the tape 64 are then moved from the transition section 82 into and through the die section 88 wherein the longitudinal edge portions are formed into overlapped relation.

Figure 13:
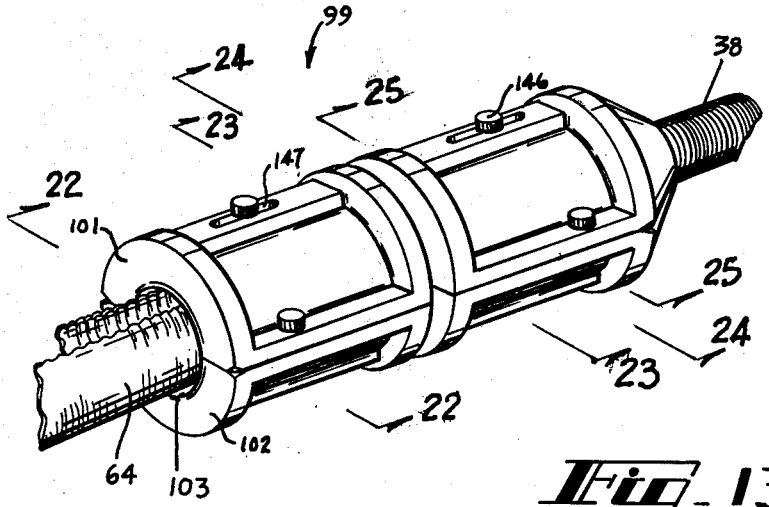
FIG. 13 shows an enlarged perspective view of an overlap and forming tool of a die section of a system in accordance with this invention for forming a tape into a tube.

From the preparation section 81 in which the tape 64 has been formed partially about the core 32, the tape together with the core is moved into a tool 99 supported within the final die section 83 (see FIGS. 5 and 13). The longitudinal edge portions 45 and 48 of the tape 64 are moved into engagement with guideways in a forming key, designated generally by the numeral 100 (see FIGS. 5 and 14–18), which is mounted in the tool 99 and which includes an upper half 101 and a lower half 102. The key halves 101 and 102 are such that when they are assembled, a passageway 103 therethrough is tapered along its length, e.g. at about an angle of 2 degrees, with a larger cross-section at the entrance or upstream end of the tool 99.

Figure 14:
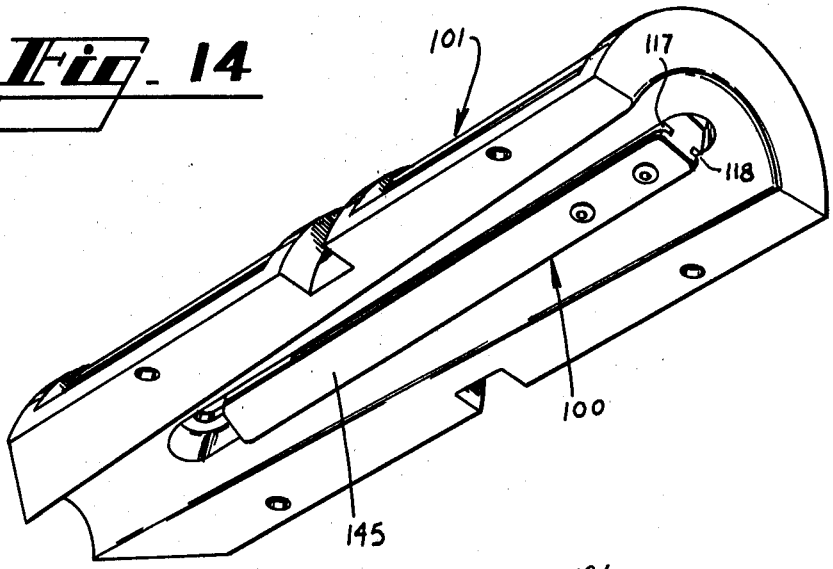
FIG. 14 shows a perspective view of a top portion of the overlap and forming tool of the die section of FIG. 13.

As shown in FIG. 14, the key 100 is positioned along a longitudinal centerline of the upper half 101 and extends from a position inwardly of the entrance toward an exit end of the tool 100. However, it should be understood that it may be important to have the seam 38 formed along the lower portion of the cable or on either side in which case the key 100 would be repositioned by rotating the tool 99. The key 100 causes longitudinal edge portions of the tape 64 to form an overlapping seam 38 with formed extremities 45 and 48 as illustrated in FIG. 3, in accordance with the principles of the present invention.

Figures 19, 20, 21:
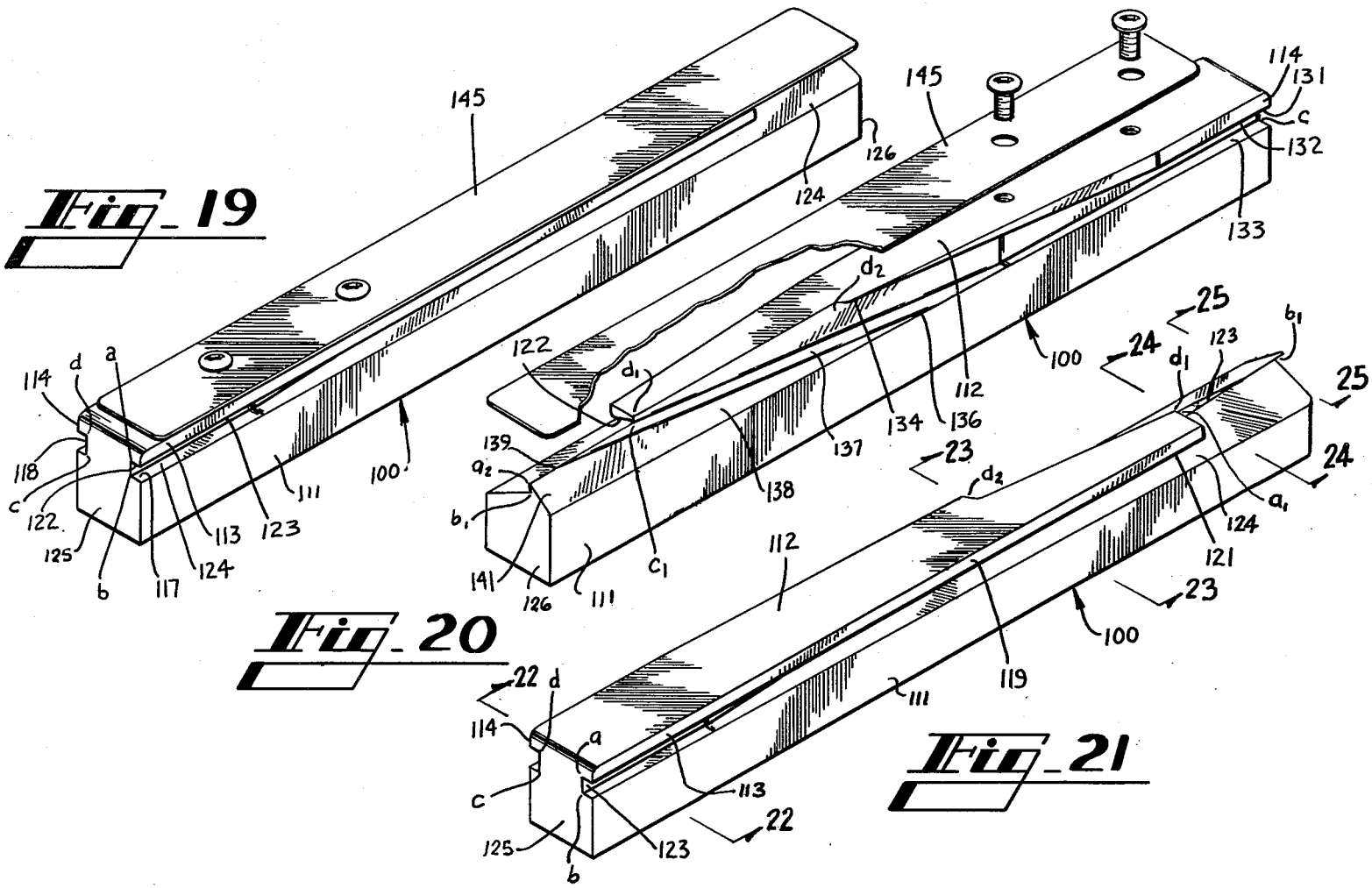
FIG. 19 is an enlarged perspective view of the forming key in a rotated position from that shown in FIG. 14 in order to show a guideway for forming an overlying longitudinal edge portion of the tape and a separator strip.
FIG. 20 is another enlarged view of the forming key of FIG. 19 but rotated from that shown in FIG. 19 to show a guideway for an underlying edge portion of the tape and exploded for purposes of clarity.
FIG. 21 is a perspective view of the key shown in FIG. 19 without the separator strip.

Reference will be made to FIGS. 19–21 to describe in detail the key 100, but it should be understood that the key in these figures is inverted from its position shown in the remainder of the drawings. As may be seen, the key 100 includes a main body portion 111 and a tapered wedge portion 112 which extends into the aperture 103 and forms two overhanging side walls 113 and 114. Each of the side walls 113 and 114 tapers inwardly and together with the main body portion 111 forms a groove or guideway 117 and 118 which extend toward the exit end of the key 100. One of those guideways, designated 117, is destined to form the overlying edge portion 45 of the shield 38 while the other guideway, designated 118, is designed to form the underlying edge portion 48.

Turning now to the portion of the key 100 which defines the groove 117, it is seen that the side wall 113 extends parallel to the main body portion for a length 119 after which it angles slightly inwardly along a length 121. The guideway 117 is defined by an underside 122 of the overhanging side wall 113, by an inner wall 123 and by a surface 124 of the main body portion 111. As the guideway extends from an entrance end 125 of the key 100 to an exit end 126 thereof, its configuration changes so that it extends farther toward the center line of the key 100, so that the surface 122 slopes inwardly upwardly as seen in FIG. 20 toward the exit end 126 of the key, and so that the surface 124 extends upwardly and inwardly. Also, while the surface 123 is peripendicular to the surface 124 at the entrance end 125, it makes an acute angle therewith adjacent the exit end 126 (see also FIG. 25).

Viewing FIG. 21, it may be said that point "a" at the entrance end moves up and inwardly to point "$a_1$" (see FIG. 21) as the guideway opens near the exit end 126 of the key 100. Moreover, the point "b" moves upwardly and inwardly to a point "$b_1$" at the exit end 126 of the key 100. This geometry causes the height of the guideway 117 at the exit end 126 of the key 100 to be decreased over that at the entrance end 125 and is designed to form the longitudinal edge portion 45 with a generally crimped configuration (see FIG. 3).

Going now to FIG. 20, it will be seen that the guideway 118 is formed by an underside surface 131 of the side wall overhang 114, an inner wall 132, and an upper surface 133 of the main portion 111. The top wall 114 decreases in height as it extends toward the exit end 126 of the key 100 with the height of the guideway decreasing to a fraction of a centimeter, i.e. about 0.10 cm, at the exit end. The point "c" moves upwardly and inwardly to a point "$c_1$" while the point "d" moves upwardly and inwardly to the point "$d_1$" at the end of the surface 132. The overhanging wall 114 ends in the vicinity of 134 whereat point "d" has become point "$d_2$".

Unlike the lower surface 124 which defines the groove 117 and which is substantially uniplanar, the surface 133 is transformed into multifaceted surfaces 137 and 138 at a point 136 with the surface 137 ending in an apex 139 at the exit end 126 of the key 100. The surface 138 has a substantial width at an exit end 141 thereof. This side of the key 100 causes the underlying edge portion 48 of the tape 64 to assume the configuration shown in FIG. 3.

The key 100 further includes a relatively flexible metallic strip separator 145 having a thickness of about 0.03 cm which is attached to a top surface 112 of the key and which extends substantially from the entrance end 125 of the key 100 to the exit end 126 thereof. The separator 145 is especially useful in preventing engagement of a tape which is used to form an outer shield about an inner shield at the overlapped seam portion unit after the seam portions have been formed. It also is helpful in a single shield cable in preventing the juxtaposition of the longitudinal edge portions with the core 32 until after they have been formed as shown in FIG. 3.

Another feature of the die section is the adjustable mounting of the key 100 in the tool 99 by means of fasteners 146—146 in slotted holes 147—147 (see FIG. 13). In this way, the position of the key 100, which is also easily removable from the tool 99, along the length of the tool may be adjusted to change, for example, the location of a so-called zero point, i.e. "$d_1$" of juxtaposition of the longitudinal edge portions. Also, the tool 99 is easily removable from the die section 83 so that tools appropriately sized to the particular diameter core 32 may be used.

In operation, the unformed aluminum strip 59 is advanced from the supply reel 58 through the corrugator 61 to provide corrugations of the necessary width and depth to form the aluminum shield 34. The aluminum tape 59 is wrapped about the core 32 to form an open seam as shown in FIG. 1.

Figure 22:
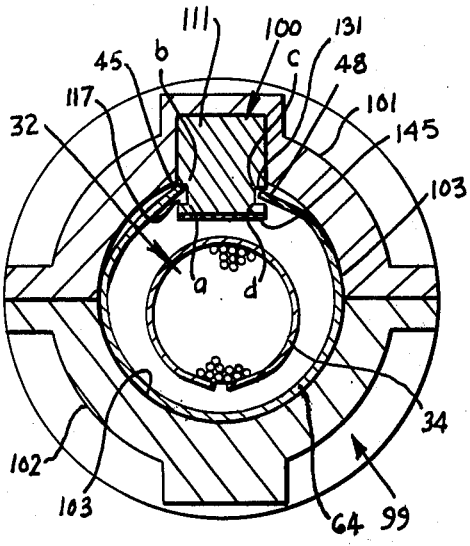
FIG. 22 shows an enlarged view of the overlap and forming tool during the forming of an outer shield about an inner shield that encloses a cable core and taken along the line 22—22 of FIG. 13 with section lines for the key shown also in FIGS. 15 and 21 for purposes of clarity.
Figure 23:
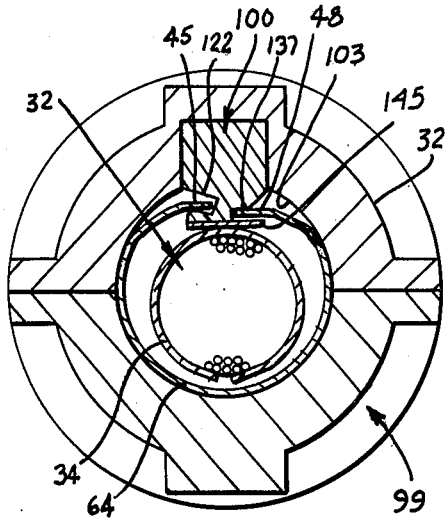
FIG. 23 shows an enlarged view similar to FIG. 22 but taken substantially on the line 23—23 of FIGS. 13, 15 and 21.

A leading end of a supply of tape 64 is tapered to facilitate its insertion into the aperture 103 of the tool 99. Successive increments of the tape 64 are corrugated and together with the aluminum shielded core 32 are passed through the preparation section 81, where the tape 64 is partially formed around the tube 86 in a substantially U-shaped configuration, as shown in FIG. 11. As the core 32 with the fully and partially formed shields therearound pass into the transition section 82, the somewhat U-shaped configuration will be altered so that the free ends of the "U" will be curved and spaced, as shown in FIG. 22, to enter the overlapping tool 99 of the die section 83. The rings 93—93 are effective to prepare the edge portions 45 and 48 of the tape 64 so that they will enter the guideways 117 and 118 of the key 110 in the die section 83.

As the partially formed shield 37 enters the tool 99, the core 32 is disposed along the centerline of the die section with the longitudinal edge portion 45 of the tape 64 received in the guideway 117 and the other edge portion 48 received in the guideway 118. If reference is made to FIGS. 22–25 and to FIGS. 13, 15 and 21 whereat these sectional views are taken, the formation of the edge portions 45 and 48 is shown at several steps aong the length of the key 100 with appropriate numerical designations corresponding to the designation of the tool in FIGS. 19–21. The longitudinal edges of the tape 64 abut or substantially abut the side walls 113 and 114, as the core 32 and partially formed tape enter the key 100, as is shown in FIG. 22. Obviously, the guideways 117 and 118 must be of sufficient height to accommodate the corrugated tape 64 which has a thickness of about 0.015 cm, a height of corrugations in the range of about 0.075 to 0.125 cm and a center-to-center spacing of corrugations of about 0.25 cm.

Figure 16:
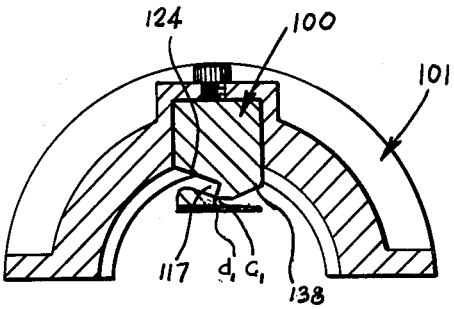
FIG. 16 shows an enlarged cross-sectional view of the top portion of the overlap and forming tool taken substantially on the line 16—16 in FIG. 15.
Figure 15:
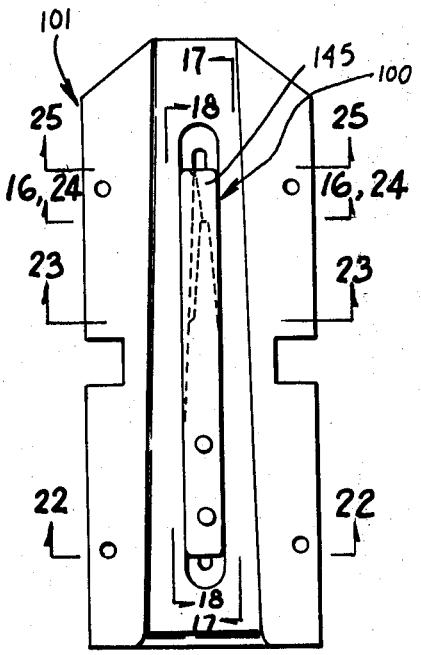
FIG. 15 is a plan view of the top portion of the overlap and forming tool of FIG. 14 and taken from its underside.
Figure 17:
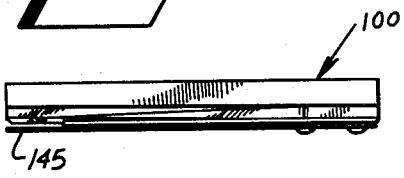
FIG. 17 shows a side elevational view of a forming key of the overlap and forming tool taken substantially on the line 17—17 of FIG. 15.
Figure 18:
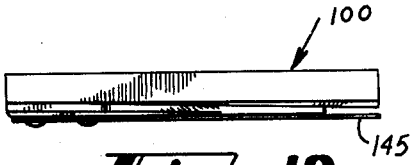
FIG. 18 is a side elevational view of the forming key taken on the lines 18—18 of FIG. 15.
Figure 24:
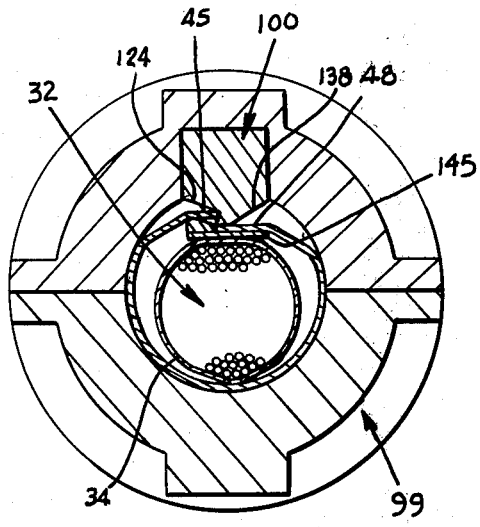
FIG. 24 is a view similar to FIG. 23 but taken on the line 24—24 of FIGS. 13, 15 and 21 at a point along the forming key where the longitudinal edges of the tape are aligned radially but spaced apart.

As the radius of the aperture 103 in the tool 99 decreases, the clearance between the core 32 and the walls which define the aperture decreases (see FIG. 24). The edge portions of the tape 64 approach what is called a "zero" point, "$d_1$", but at different levels, as shown in FIG. 16. It is important to recognize that unlike prior art forming tools, both edge portions 45 and 48 are positively controlled during the forming thereof in the die section 83.

The underlying edge portion 48 is supported along its longitudinal edge and portions of its major surfaces adjacent the edge along at least a portion of the length of the key 100. Specifically, the guideway 118 extends to the point "$d_2$" (see FIGS. 20 and 21) after which only the longitudinal edge of the tape 64 and an outwardly facing major surface are supported by the key 100 (see FIG. 23). However, because of the complete support of the edge portion of the tape 64, which is to become the underlying edge portion, up to the point "$d_2$", the tape generally remains in engagement with the surface 137 to the point "$d_1$".

As the shielded core 32 passes beyond the point "$d_1$" (see FIG. 20), the two edge portions of the tape 64 begin to overlie each other with the edge portion 45 being the outer or overlying edge portion and directed inwardly into substantially continuous engagement with the edge portion 48 with the amount of the overlap for a 5 cm diameter cable being about 0.5 cm. Because of the guideway 118 and the limited length of less than complete support between points "$d_2$" and "$d_1$", deflection of the underlying edge portion 48 is prevented while the overlying edge portion is directed inwardly. The distance between the points "$d_2$' and "$d_1$" may vary between different keys 100—100 depending on several factors such as, for example, the size of the cable being shielded.

Figure 25:
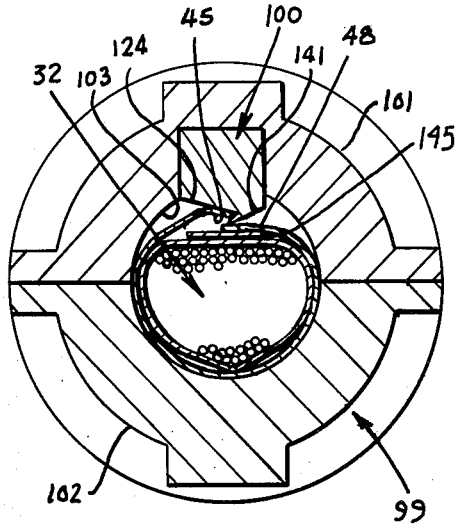
FIG. 25 is an enlarged view similar to FIG. 24 but taken on the line 25—25 of FIGS. 13, 15 and 21 and showing the inner shield and core in an exaggerated out-of-round configuration.

Since the aperture 103 continues to taper inwardly after the key 100 ends, the shielded core 32 is sized from its exaggerated configuration shown in FIG. 25 to the substantially circular configuration shown in FIG. 3 as it exits the tool 99. The tool 99 is effective to cause both the formation of the extremity 45, as well as the overlapping of the edge portion 48 of the tape to form a substantially closed seam and to effectively size the shielded core to facilitate pressure extrusion of the jacket 39.

As will be recalled, the leading end of the tape 64 of a supply is tapered to facilitate its insertion into the aperture 103 of the tool 99. The relatively wide, sloping surfaces 124 and 138 at the inner end 126 of the key 100 are effective to load the tape 64 and cause the longitudinal edges thereof to overlap each other instead of being trapped at abrupt intersections which are often encountered in conventional die-key assemblies.

As should be apparent, the tapes 59 and 64 are formed with the seams being a predetermined angle apart, such as, for example, 180°. It has been found that once the aluminum shield 34 has been formed over the core 32, the wrapping of the steel shield 38 about the aluminum often results in an edge of the steel tape becoming embedded in the aluminum and causing the latter to rotate. This causes an undesirable change in the angle between the seams. In order to overcome this problem, the key 100 which forms the steel tape about the aluminum shielded core includes the thin flexible strip 145 which is fastened to a leading edge of the key 100 and which extends along its length. The strip 145 is effective to maintain the steel tape 64 separated from the aluminum shield 34 until after the edge portions of the steel tape have been formed thereby avoiding any embedment into the aluminum.

While in the preferred embodiment of the system 60, only the key 100 which forms the steel tape is provided with a separator strip 145, it is within the scope of this invention to use a similar tool to form the aluminum strip with either an open or an overlapped seam. Moreover, while a conventional tool may be used to form the aluminum shield 34 with an open or closed seam, it is within the scope of this invention to use another forming system 60 to form the tape 59 into the shield 34.

As the shielded unit leaves the die section 83, it passes through the binder 67, the extruder 68, the water trough 61, the capstan 71, and the footage counter and marker 72 and onto the reel 73.

While the instant invention has been described with respect to cables having shields of both aluminum and steel, it should be understood that it may be utilized to form a cable having only a single shield which has sufficient rigidity to cause rebound or spring-back of the overlapping edge portion, to prevent the edge portion 47 from protruding, as shown in FIG. 2. Further, while the invention has been described in the manufacture of a cable having a filling of petrolatum compound alone or combined with low-density polyethylene, it should be understood that the cable core may be unfilled.

Also, while the invention has been described in the shielding of a cable core 32, it should be apparent that the invention could be used in the forming of a metal covering over any elongated member, as well as in the forming of a metallic tape into a tube.

It is to be understood that the above-described arrangements are simply illustrative of the invention. Other arrangements may be devised by those skilled in the art which will embody the principles of the invention and fall within the spirit and scope thereof.

What is claimed is:

1. A method of forming a corrugated metallic tape into a substantially circular tube having an overlapped seam, said method comprising the steps of:

moving successive increments of length of a corrugated metallic tape into engagement with a coverging, generally conically shaped surface to cause the successive increments to have at least a partially curved configuration with longitudinal edges of the successive increments being adjacent each other;

moving the successive increments having the at least partially curved configuration through a plurality of adjacent sequentially decreasing openings to cause the tape to have a generally circular configuration; then providing confinement for longitudinal edge portions of the tape for at least a portion of a length of a path of travel along which they are to be formed into a seam to engage longitudinal edges of the tape, said step of providing confinement being accomplished substantially without encumbering an area enclosed by the metallic tape being formed into a tube; while moving the successive increments of the tape along a path of travel with the confinement of the longitudinal edge portions being effective to form an overlapped seam having an underlying edge portion and an overlying edge portion which is directed inwardly into substantially continuous engagement with the underlying edge portion.

2. A method of wrapping a corrugated metallic tape about a cable core to enclose the core in a shield having a substantially circular configuration and having a preformed, overlapped seam, said method comprising the steps of:

advancing a cable core along a path of travel through a tube and a die;

moving successive increments of length of a corrugated metallic tape into engagement with a converging, generally conically shaped surface which is disposed about said tube to cause the successive increments to have at least a partially curved configuration with longitudinal edges of the successive increments being adjacent each other;

moving the successive increments having the at least partially curved configuration through a plurality of adjacent, sequentialy decreasing openings to cause the tape to have a generally circular configuration; then providing individual confinement for longitudinal edge portions of the tape for at least a portion of the length of the path of travel along which they are formed into a seam to engage the longitudinal edges of the tape; while moving the cable core and the tape through the die along the portion of the path of travel with the confinement of the longitudinal edge portions being effective to form an overlapped seam having an underlying edge portion and an overlying edge portion which is directed inwardly into substantially continuous engagement with the underlying edge portion to preclude its protrusion into a plastic jacket which is substantialy extruded over the enclosed core.

3. The method of claim 2, wherein the cable core is enclosed in a first shield having a longitudinal seam and the metallic tape is wrapped about the core which is enclosed in the first shield to form a second shield with the longitudinal seam of the first shield spaced a predetermined angle from the overlapped seam of the second shield.

4. The method of claim 3, wherein the longitudinal edge portions of the tape are maintained out of engagement with the first shield until the overlapped seam in the second shield has been substantially completely formed.

5. The method of claim 2, wherein the longitudinal edges of the tape are caused to be superimposed but spaced apart in a radial direction and then overlapped within a predetermined distance along said path.

* * * * *

UNITED STATES PATENT AND TRADEMARK OFFICE

CERTIFICATE OF CORRECTION

PATENT NO. : 4,308,662

DATED : January 5, 1982

INVENTOR(S) : William D. Bohannon, Jr.

It is certified that error appears in the above—identified patent and that said Letters Patent is hereby corrected as shown below:

Col. 10, line 26 "coverging," should read ---converging,--- line 69 "sequentialy" should read ---sequentially---.

Signed and Sealed this

*Sixth* Day of *April 1982*

[SEAL]

*Attest:*

GERALD J. MOSSINGHOFF

*Attesting Officer* *Commissioner of Patents and Trademarks*